US005122068A

United States Patent [19]

Koss

[11] Patent Number: 5,122,068

[45] Date of Patent: Jun. 16, 1992

[54] CABLE GROUNDING DEVICE

[76] Inventor: Michael R. Koss, 3318 N. Gale, Indianapolis, Ind. 46218

[21] Appl. No.: 684,578

[22] Filed: Apr. 12, 1991

[51] Int. Cl.[5] ..... H01R 4/66

[52] U.S. Cl. ..... 439/98; 439/785

[58] Field of Search ..... 439/92, 98, 190, 785, 439/796; 174/35 R, 48

[56] References Cited

U.S. PATENT DOCUMENTS

| | | | |
|---|---|---|---|
| 3,568,128 | 3/1971 | Taylor | 439/98 |
| 4,201,433 | 5/1980 | Caldwell | 439/98 |
| 4,708,418 | 11/1987 | Reyna | 439/785 |

FOREIGN PATENT DOCUMENTS

| | | | |
|---|---|---|---|
| 2-65075 | 3/1990 | Japan | 439/98 |

*Primary Examiner*—Eugene F. Desmond
*Attorney, Agent, or Firm*—Ice Miller Donadio & Ryan

[57] ABSTRACT

A grounding block is provided for engaging at least one continuous coaxial cable. The grounding block includes an electrically conductive base member having an upper surface, a lower surface, a front surface and a rear surface. The upper surface of the base member includes a hemicylindrical trough extending between the front surface and the rear surface of the base member. The hemicylindrical trough includes a first enlarged radius portion disposed adjacent to the front surface, a second enlarged radius portion disposed adjacent to the rear surface, and reduced radius portion extending between the first and second enlarged radius portion. A corresponding electrically conductive cap member is also provided. A fastener is provided for fastening together the cap member and the base member to align the hemicylindrical troughs of the base member and the cap member to form a cylindrical bore extending between the front surfaces of the base and cap members, and the rear surfaces of the base and cap members.

15 Claims, 4 Drawing Sheets

CABLE GROUNDING DEVICE

TECHNICAL FIELD OF THE INVENTION

The present invention relates to electrical grounding devices, and more particularly to a device for grounding coaxial cables used in communication transmission lines.

BACKGROUND OF THE INVENTION

Communications transmission facilities typically require an antenna through which the communications signal, such as a radio or television signal, is transmitted and received. Usually, this antenna is mounted at the top of an outdoor transmission tower. Coaxial cable is typically used to carry the communications signal from the communications transmitter/receiver to the antenna on top of the tower.

As will be appreciated, such towers and antennas are subject to being struck by lightning or electrified with respect to earth by inductive coupling to overhead discharges. If lightning does strike a radio transmission tower, voltage from the electric shock will usually be transmitted through the tower, and through any of the coaxial cables extending up the tower between the antenna and the transmitter/receiver.

Design engineers and professional communication consultants have known and advised for many years that one of the most important and useful features of a communications tower installation is direct, low inductance grounding of the coaxial line shields. Lightning-/EMP protection, receiver noise reduction, transmitter interference leakage, and poor shield integrity are all problems which can occur if a coaxial transmission line is not grounded properly.

Several commercial products exist for dealing with the problems caused by lightning strikes of antenna towers.

For example, the assignee of the instant application, Industrial Communications Engineers, Ltd., manufactures several coaxial lightning/EMP suppressors which are designed to constantly short circuit and shunt voltage transients caused by lightning, power line induction, wind, rain, snow and various types of explosive releases.

Additionally, the assignee manufactures rotor cable transient voltage suppressors and RF bypass units, ground hub kits, and guy wire compression grounding kits. Rotor cable transient voltage suppressors and RF bypass units are provided to discharge voltage charges of any polarity and origin, and include rapid firing MOV pulse suppressors across each circuit.

Ground hub kits provide a compressive connection for mounting directly to ground rod tops to provide connection points for ground wires leading from the ground rod tops. Guy wire compression grounding kits are typically coupled to guy wires used to support the tower, and are designed to preserve earth-neutral integrity, reduce receiver noise, and help to prevent reradiation or rectification of transmitted signals. Typically, the guy wire compression grounding kits comprise a block having a first bore attachable to the guy wire, and a second bore attachable to a grounding wire.

The patent literature also includes examples of various grounding devices.

Alexander, Jr. published United States Statutory Invention Registration No. H379 relates to a combination strain relief and ground connection for a shielded cable.

The Alexander device comprises a two member device molded from an ABS/polycarbonate polymer, or a NORYL or TREVEX polycarbonate copolymers. The two members of the Alexander device are attached by sonic welding. Channels are formed in the exterior of the housing members to enable the device to be received by a notch of an electrically grounded chasis.

Haws U.S. Pat. No. 3,852,700 relates to a grounding base for a connector which is adaptable to be placed between a plug and a socket. The conductor base shown in Haws comprises a generally planar sheet having a plurality of apertures through which the prongs of a plug can extend.

Grabbe U.S. Pat. No. 4,653,840 relates to an electrical connection for four shielded coaxial conductors. The Grabbe device includes a pair of housing blocks that must have conducting surfaces, and can be made of metal if desired. A compressing block is placed between the two housing blocks, and is provided for mating the core conductors of a pair of coaxial cables. The Grabbe device is illustrative of one of the prior art situations the applicants device seeks to overcome in that one of the functions of Grabbe's compression block is to build a good splice between a pair of coaxial cables.

It is therefore one object of the present invention to provide a device for grounding coaxial cables without the need to interrupt the cable by splicing.

SUMMARY OF THE INVENTION

In accordance with the present invention, a grounding block is provided for engaging at least one continuous coaxial cable having a first sheathed portion, a second sheathed portion and a sheath removed portion disposed between the first sheathed portion and the second sheathed portion. The grounding block comprises an electrically conductive base member having an upper surface, a lower surface, a front surface and a rear surface. The upper surface includes a hemicylindrical trough extending between the front surface and the rear surface of the base member. The hemicylindrical trough includes a first enlarged radius portion disposed adjacent to the front surface, a second enlarged radius portion disposed adjacent to the rear surface, and a reduced radius portion extending between the first and second enlarged radius portions. An electrically conductive cap member has an upper surface, a lower surface, a front surface and a rear surface. The lower surface of the cap member includes a hemicylindrical trough extending between the front surface and the rear surface of the cap member. The hemicylindrical trough includes a first enlarged radius portion disposed adjacent to the front surface, a second enlarged radius portion disposed adjacent to the rear surface, and a reduced radius portion extending between the first and second enlarged radius portions. A fastening means is provided for fastening together the cap member and the base member to align the hemicylindrical troughs of the base member and the cap member to form a cylindrical bore extending between the front surfaces of the base and cap members, and the rear surfaces of the base and cap members. The cylindrical bore includes a first enlarged diameter portion for snugly receiving the first sheathed portion of the continuous coaxial cable, a second enlarged diameter portion for snugly receiving the second sheathed portion of the continuous coaxial cable, and a reduced diameter portion extending between the first and second enlarged diameter portions for receiving the sheath removed portion of the continuous coaxial cable.

Preferably, an electrically conductive mounting fixture is also provided having at least one generally planar surface. A second fastening means is provided for fastening at least one of the cap member and the base member to the mounting fixture to form an electrically conductive surface-to-surface contact between the mounting fixture and the grounding block.

Additionally, electrically conductive anti-oxidizing means can be provided which is placable in an electrical contact with the sheath removed portion of the cable, the reduced radius portion of the trough of the cap member, and the reduced radius portion of the base member. The electrically conductive anti-oxidizing means can be comprised of a thin film of a metal particle and graphite containing hydrophobic paste placable on the sheath removed portion of the cable to substantially fill any spaces between the sheath removed portion of the cable and the reduced radius portion of the troughs of the cap member and base member.

One feature of the present invention is that the grounding block is made from an electrically conductive material. This feature has the advantage of providing a good path through which the electricity to be grounded can flow. Further, this feature provides a large surface area between the cable to be grounded and the block to help ensure that the electricity flowing through the cable flows into the grounding block, and from the grounding block to ground.

Another feature of the present invention is that the bore provided in the block through which the cable passes includes an enlarged diameter portion adjacent to the front and rear faces of the block, and a reduced diameter portion in the central portion of the bore. The enlarged diameter portions are sized to snugly receive the sheathed portion of the cable. The reduced diameter portion of the bore is sized to receive a portion of the coaxial cable from which the sheath has been removed. This feature has the advantage of accommodating a continuous coaxial cable, and thereby obviating the need for splicing the cable, thus a constant impedance of the transmission line. By sizing the enlarged diameter portions of the bore to receive the sheathed portion of the cable, it is more difficult for moisture to come in contact with the unsheathed portion of the cable. As will be appreciated, the contact of moisture with the unsheathed portion could result in interruption of the smooth flow of current from the cable to the grounding block.

One unexpected advantage obtained with the present invention is that the use of the present invention helps to improve the performance of the coaxial cable to which it is attached. As will be appreciated, no transmission line is completely efficient in preventing leakage from and into the line. Surprisingly, the applicants found that the present invention reaffirms the shield in a transmission line when the device is installed properly with a low impedance ground. The applicants found that the device helps to reduce both the transmission leakage and reception noise of the coaxial cable to which it is attached.

These and other features of the present invention will become apparent to those skilled in the art upon review of the detailed description of a preferred embodiment of the present invention exemplifying the best mode of practicing the invention, as perceived presently.

DETAILED DESCRIPTION

Figure 1:
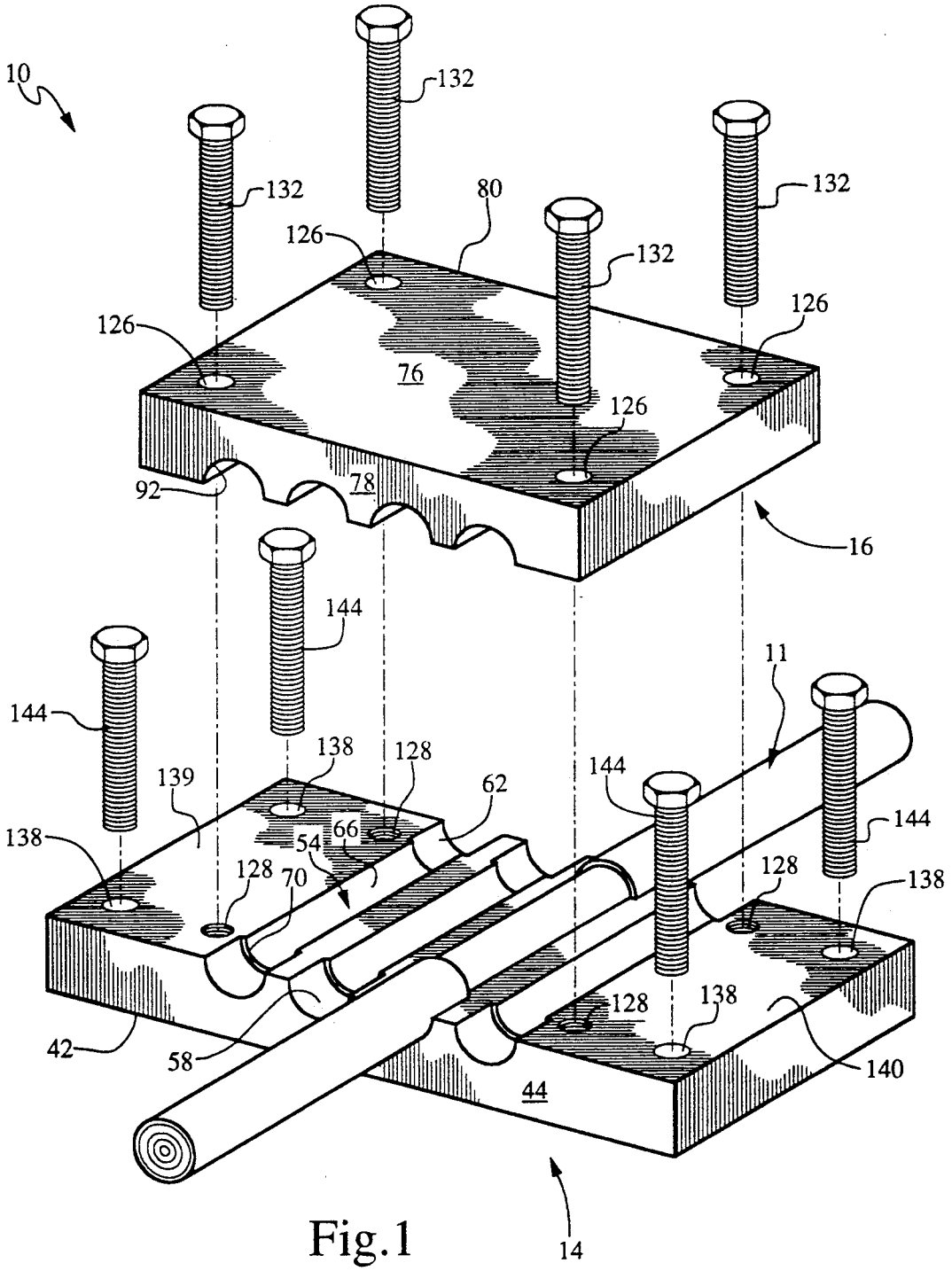
FIG. 1 is a perspective view of the present invention.
Figure 2:
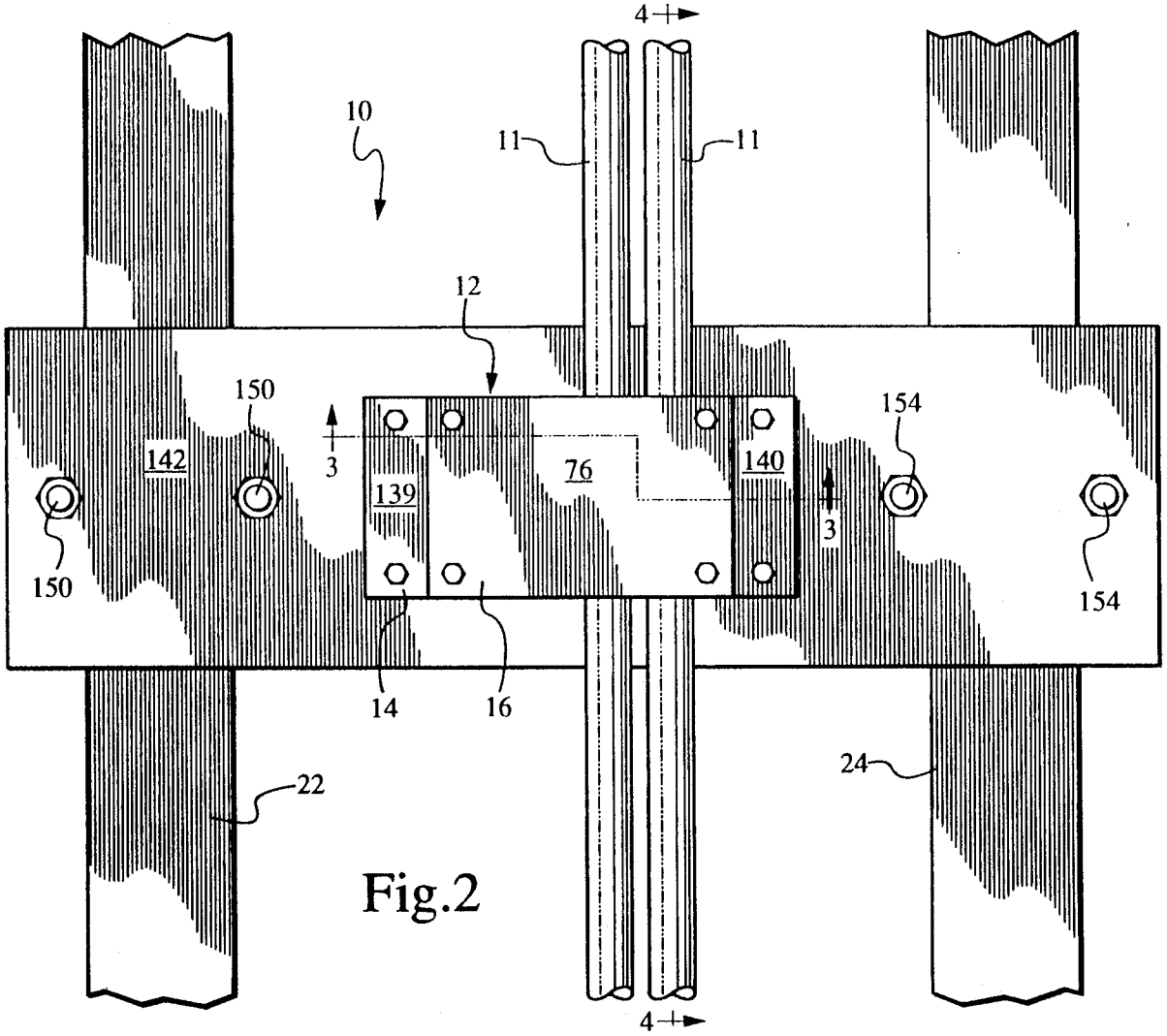
FIG. 2 is a top view of the present invention as attached to a transmission tower.

The grounding system 10 of the present invention is best shown in FIGS. 1 and 2. The grounding system 10 provides an electrical ground for a continuous coaxial cable 11, and includes an electrically conductive grounding block 12 preferably made from an extruded, weather resistent metal such as aluminum, stainless steel, phosphor bronze, aluminum bronze or brass.

The grounding block 12 includes a base member 14 and a cap member 16, and is designed to be mounted to an electrically conductive mounting fixture 20. The mounting fixture 20 is generally plate-like in construction, and is designed to be mounted to a pair of legs 22, 24 of a transmission tower such as a radio or television transmission tower.

Figure 3:
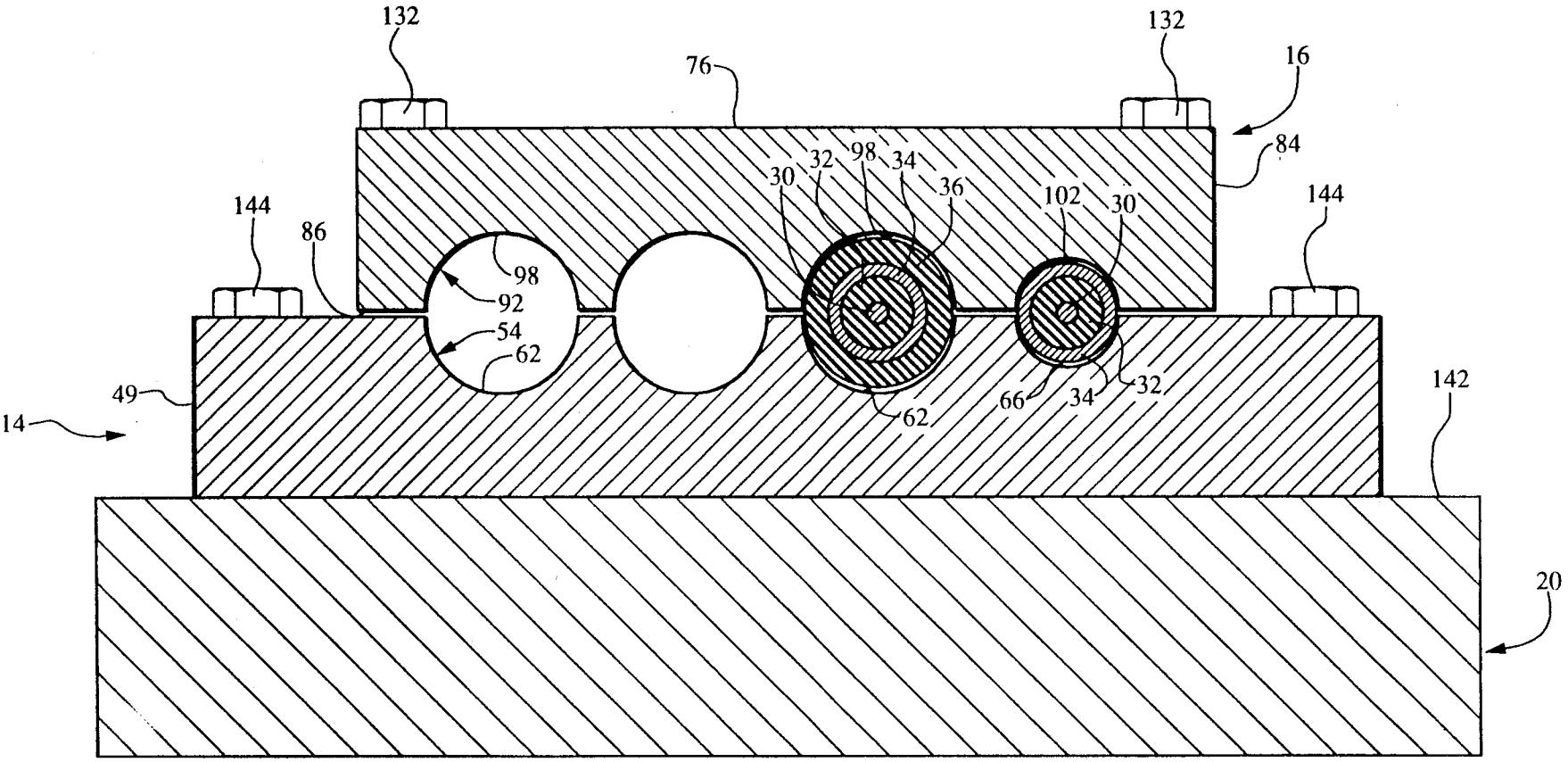
FIG. 3 is a sectional view taken along lines 3—3 of FIG. 2.
Figure 4:
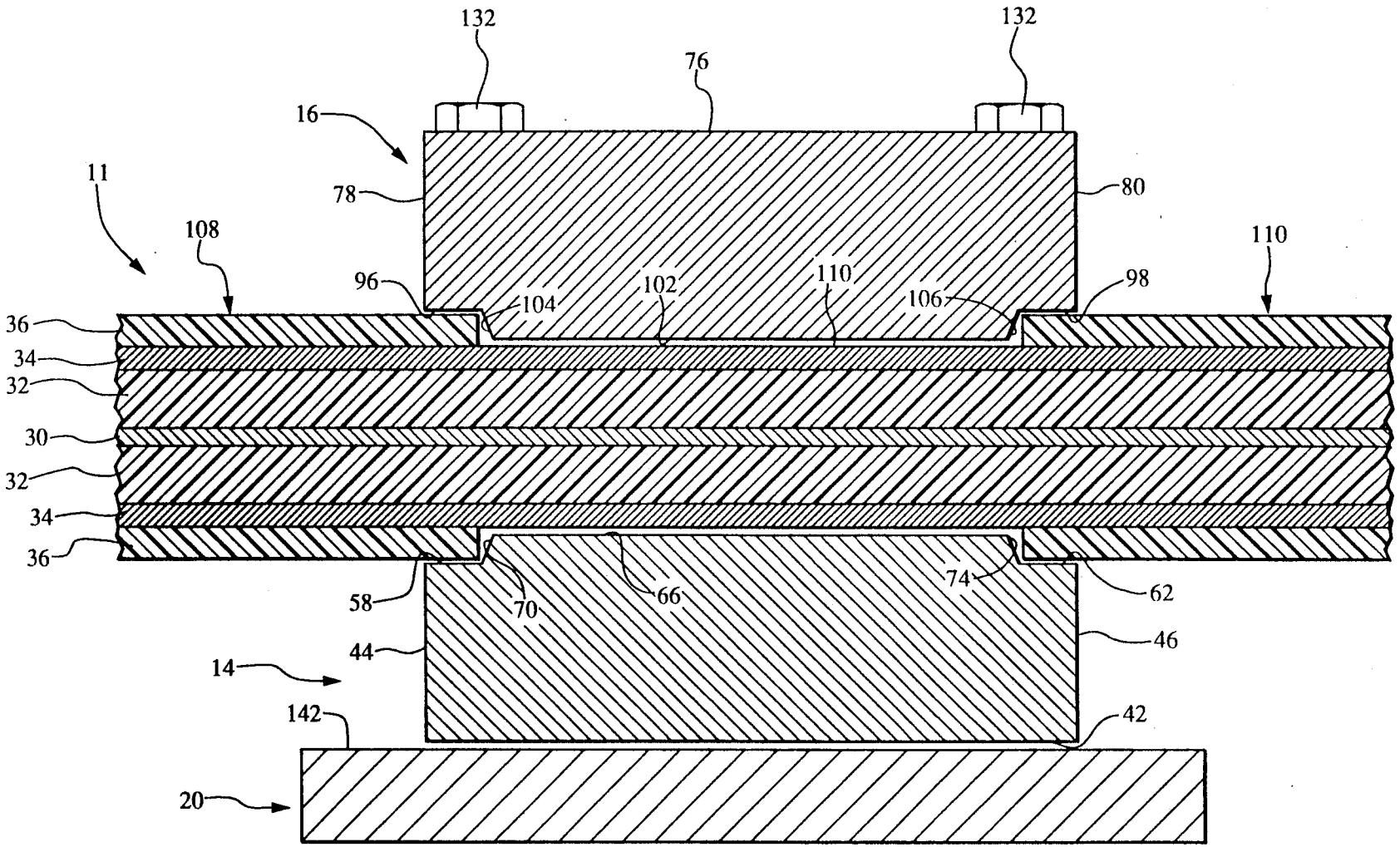
FIG. 4 is a sectional view taken along lines 4—4 of FIG. 2.

The coaxial cable 11 is best shown in FIGS. 3 and 4. As will be appreciated to those familiar with coaxial cable, the coaxial cable 11 has a generally round cross section to form a generally cylindrical cable. The coaxial cable 11 includes a core conductor 30 disposed at the center of the coaxial cable 11. The core conductor 30 is overlain by a layer of nonconductive insulation 32, which is disposed concentric with the core conductor 30. Concentrically surrounding the insulation layer 32 is an electrically conductive shield layer 34. The shield 34 can comprise a plurality of electrically conductive wires, a single, tubular electrical wire, or a metalized plastic that is applied to the outer surface of the nonconductive insulation layer 20. The outer layer of the coaxial cable 11 comprises a non-conductive sheath 36 which is preferably comprised of a plastic or rubber material. The purpose of the sheath 36 is to electrically insulate the shield 34, and to provide a weather and moisture resistent coating to the coaxial cable 11.

The base member 14 is best shown in FIGS. 2, 3 and 4 as including a generally planar lower surface 42, a generally planar front surface 44, a generally planar rear surface 46 and an upper surface 48. The base member 14 also includes generally planar left side and right side surfaces 49, 50 respectively.

A series of four parallel hemicylindrical troughs are formed in the upper surface 48 of the base member 14. The hemicylindrical troughs 54 extend between the front surface 44 and rear surface 46 of base member 14. Each of the troughs 54 includes a first hemicylindrical enlarged radius portion 58 disposed adjacent the front surface 44, a second hemicylindrical enlarged radius portion 62 disposed adjacent to the rear surface 46, and a reduced radius portion 66 that extends generally between the first enlarged radius portion 58 and the second enlarged radius portion 62.

An axially outwardly facing first frustoconical lip 70 is disposed between the first enlarged radius portion 58 and the reduced radius portion 66. An axially outwardly facing second frustoconical lip 74 is disposed between the second enlarged radius portion 62 and the reduced radius portion 66.

The cross-sectional areas of the first enlarged radius portion 58, the second enlarged radius portion 62 and the reduced radius portion 66 are generally constant throughout the lengths of the respective portions. The cross-sectional area of the first enlarged radius portion 58 is generally equal to that of the second enlarged radius portion 62, with the reduced radius portion 66 having a cross-sectional area smaller than either of the first and second enlarged radius portions 58, 62. As will be explained in more detail below, the radius chosen for the first and second enlarged radius portions 58, 62 and the reduced radius portion 66 depends largely on the diameter of the coaxial cable 11 with which the grounding block 12 is to be used.

The spacing between the troughs 54 is also dependent upon the size of the cable 11 to be used with the grounding block 12. In one embodiment particularly useful for size RG8 coaxial cable, the centers of each of the troughs 54 are spaced apart by about 0.5625 inches (1.43 cm.) The cap member 16 is constructed generally similarly to the base member 14. The cap member 16 includes a generally planar upper surface 76, a generally planar front surface 78, a generally planar rear surface 80, a generally planar left surface side surface 82, and a generally planar right side surface 84. The cap member 16 also includes a lower surface 86 that is matable with the upper surface 48 of the base member 14 to place the lower surface 86 of the cap member 16 in an opposed, adjacent relation to the upper surface 48 of the base member 14.

A series of four, generally parallel hemicylindrical troughs 92 are formed in the lower surface 86 of the cap member 16. The troughs 92 extend between the front and rear surfaces 78, 80 of the cap member 16. The troughs 92 are formed to be mirror images of the trough 54. Each trough 92 includes a hemicylindrical first enlarged radius portion 96 disposed adjacent to the front surface 78 of the base member, a hemicylindrical second enlarged radius portion 98 disposed adjacent to the rear surface of the cap member 16 and a reduced radius portion 102 extending generally between the first enlarged radius portion 96 and the second enlarged radius portion 98.

Each of the troughs 92 also includes an axially outwardly facing first frustoconical lip 104 disposed between the first enlarged radius portion 96 and the reduced radius portion 102, and an axially outwardly facing second frustoconical lip 106 disposed between the second enlarged radius portion 98 and the reduced radius portion 102.

The cap member 16 is matable to the base member 14 so that the series of parallel troughs 92 of the cap member 16 and the series of parallel troughs 54 of the base member 14 form a series of generally cylindrical bores. Each of the cylindrical bores includes a first enlarged diameter portion corresponding generally to the mated first enlarged radius portions 58, 96 of the base member 14 and cap member 16; a second enlarged diameter portion corresponding generally in position to the mated second enlarged radius portions 62, 98 of the base member 14 and cap member 16; and a reduced diameter portion corresponding in position generally to the mated reduced radius portions 66, 102 of the base member 14 and cap member 16. As will be appreciated, the diameter of the first enlarged diameter portion, second enlarged diameter portion and reduced diameter portion corresponds generally to twice the radius of each of the first enlarged radius portions 58, 96, second enlarged radius portions 62, 98, and reduced radius portions 66, 102, respectively. Each of the first enlarged diameter portion, second enlarged diameter portion and reduced diameter portion of the cylindrical bore is generally smooth, and has a constant cross-section throughout its length.

As will be appreciated, the diameter chosen for the cylindrical bore will depend largely on the size of the particular cable for which the grounding block 12 is designed. In general, the diameter of the reduced radius portion is sized to be slightly smaller (usually by about 16 thousandths of an inch) than the diameter of the sheath removed portion of the coaxial cable 11 so that the sheath-removed portion of the coaxial cable fits snugly within the reduced radius portion of the cylindrical bore. The diameters of the first and second enlarged diameter portions of the cylindrical bore are sized to be slightly smaller than the diameter of the first 108 and second 110 sheathed portions of the coaxial cable 11. Generally, the diameter of the first and second enlarged portions should each be about 0.030 inches (0.076 cm.) less than the diameter of the cable 11, so that when the cap member 16 is joined to the base member 14, the engagement of the enlarged diameter portions 58, 62, 96, 98 of the base member 14 and cap member 16 and the sheath 36 of the coaxial cable 11 forms a seal that will prevent moisture from entering into the reduced radius portion of the cylindrical bore.

As best shown in FIGS. 1 and 4, a first sheathed portion 108 of the coaxial cable 11 is snugly received by and engaged by the first enlarged diameter portion of the cylindrical bore. A second sheathed portion 110 of the coaxial cable 11 is snugly received by the second enlarged diameter portion of the cylindrical bore, and the sheath removed portion 112 of the coaxial cable is snugly received by the reduced radius portion.

Preferably, the grounding block 12 is formed by an extrusion process. The reduced radius portions 66,102 of the base 14 and cap 16 members can be formed during the extrusion of the base 14 and cap 16 members. Alternately, the reduced radius portions 66,102 can be machined into the previously extruded base 14 and cap 16 members. The enlarged radius portions 58, 62, 96, 98, are best formed by a machining process after the formation of the base 14 and cap 16 members.

Electrically conductive anti-ozidizing means (not shown) are preferably placed between the sheath removed portion 112 of the cable 11 and the reduced diameter portion of the cylindrical bore to provide a better electrical coupling between the sheathed removed portion 112 of coaxial cable 11 and the reduced radius portions 66, 102 of the base number 14 and cap member 16, and to fill any spaces that might exist between the cable 11 and the base 14 and cap 16 members in the region of their reduced radius portions 66, 102. Preferably, this electrically conductive anti-oxidizing means comprises a metal particle and graphite containing hydrophobic paste which is placeable on the sheath removed portion of the cable to form a film between the cable 11 and the cap and base members 16, 14 in a sufficient quantity to substantially fill any voids between the sheath removed portion 12 of the cable 11 and the reduced radius portions 66, 102 of the base member 14 and cap member 16.

A fastening means is provided for fastening together the cap member 16 and the base member 14 to align the hemicylindrical troughs 54 of the base member with the hemicylindrical troughs 92 of the cap member 16. The fastening means includes four apertures, 126 which extend between the upper surface 76 and lower surface 86 of the cap member 16. and four threaded apertures 128 formed in the base member 14. Apertures 128 extend from the upper surface 48 of the base member 14 toward the lower surface 42 of the base member 14. Threaded apertures 128 can extend all the way through base member 14 to its lower surface 42, or may extend only partially through the base member 14. The threaded apertures 128 are positioned to align with apertures 126 of the cap member 16 and are sized to threadedly engage the threads of the stainless steel, hex head machine bolts 132 which extend through aperture 126 to engage the threads of threaded apertures 128 to engage the cap member 16 and base member 14.

Preferably, bolts 132 are hex head bolts to enable a torque wrench to engage the bolts 132 in the threaded apertures 128. The applicants have found that if the four bolts 132 are engaged with the apertures 128 at an equal pressure of about 15 foot- pounds of torque, the moisture resistance of the seals formed between the sheathed portions 108, 110 of the coaxial cable 11 and the enlarged radius portions 58, 96, 62, 98 of the troughs 54, 92 of the cap 16 and base 19 members is optimized.

A second fastening means is provided for fastening the grounding block 12 to the mounting fixture 20 in an electrically conductive relation. The second fastening means includes four apertures 138 which extend between the upper surface 48 and lower surface 42 of the base member 14. Preferably, two of the four apertures are disposed on the first flange portion 139 of the base member 14, with the other two apertures being disposed on the second flange portion 140 of the base member 14. The first flange portion 139 of the base member 14 is that portion of the base member 14 which extends outwardly beyond the left side surface 82 of the cap member 16. Similarly, the second flange portion 140 of the base member 14 is that portion of the base member 14 which extends outwardly beyond the right side surface 84 of the cap member 16.

The second fastening means also includes four threaded apertures (not shown) which extend through the mounting fixture 20, between the upper planer surface 142 of the mounting fixture and the lower surface (now shown) thereof. The four apertures (not shown) of the mounting fixture 20 serve as positioning means for positioning the grounding block 12 on the mounting fixture 20, so that when the four stainless steel hex head machine bolts 144 are passed through the apertures 138 of the base member 14 and engage the threaded apertures (not shown) of the mounting fixture, the planer lower surface 42 of the base member 14 is in an electrically conductive surface-to-surface contact with the planer upper surface 142 of the mounting fixture 20. This surface to surface contact between the ground block 12 and the mounting fixture 20 forms a low impedance, electrically conductive path between the grounding block (and hence the coaxial cables 11), and the mounting fixture 20.

A third fastening means is provided for fastening the mounting fixture 20 to the legs 22, 24 of the tower. The third fastening means comprises a first C-bolt 150 and a second C-bolt 154. Each C-bolt 150, 154 includes a pair of threaded ends which extend through apertures (not shown) in the mounting fixture 20. The middle portions of the C-bolts 150, 154 extend around the tower legs 22, 24 respectively, to engage the mounting fixture 20 to the tower legs, 22, 24.

Although the present invention has been described in detail with reference to certain preferred embodiments, those skilled in the art will recognize that variations of the present invention exist within the scope of the appended claims.

What is claimed is:

1. A grounding block for engaging at least one continuous coaxial cable having a first sheathed portion, a second sheathed portion and a sheath removed portion disposed between the first sheathed portion and the second sheathed portion, the grounding block comprising:

(1) an electrically conductive base member having an upper surface, a lower surface, a front surface and a rear surface, the upper surface including a hemicylindrical trough extending between the front surface and the rear surface of the base member, the hemicylindrical trough including a first enlarged radius portion disposed adjacent to the front surface, a second enlarged radius portion disposed adjacent to the rear surface, and a reduced radius portion extending between the first and second enlarged radius portions, (2) an electrically conductive cap member having an upper surface, a lower surface, a front surface and a rear surface, the lower surface including a hemicylindrical trough extending between the front surface and the rear surface of the cap member, the hemicylindrical trough including a first enlarged radius portion disposed adjacent the front surface, a second enlarged radius portion disposed adjacent to the rear surface, and a reduced radius portion extending between the first and second enlarged radius portions, and (3) fastening means for fastening together the cap member and the base member to align the hemicylindrical troughs of the base member and the cap member to form a cylindrical bore extending between the front surfaces of the base and cap members, and the rear surface of the base and cap members, the cylindrical bore including a first enlarged diameter portion for snugly receiving the first sheathed portion of the continuous coaxial cable, a second enlarged diameter portion for snugly receiving the second sheathed portion of the continuous coaxial cable, and a reduced diameter portion extending between the first and second enlarged diameter portions for receiving the sheath removed portion of the continuous coaxial cable.

2. The invention of claim 1 further comprising an electrically conductive mounting fixture having at least one generally planar surface, a second fastening means for fastening at least one of the cap member and the base member to the mounting fixture, and positioning means for positioning at least one of the upper surface of the cap member and the lower surface of the base member in an opposed electrically conductive relation with the generally planar surface of the mounting fixture to form an electrically conductive surface-to-surface contact between the mounting fixture and the grounding block.

3. The invention of claim 2 wherein the base member includes at least two apertures extending between the upper surface and the lower surface of the base member, and the mounting fixture includes at least two apertures in the planar surface of the mounting fixtures, the at least two apertures in the base member being (a) alignable with the at least two apertures in the mounting fixture to form the positioning means, and (b) sized for receiving the second fastening means.

4. The invention of claim 1 further comprising an electrically conductive anti-oxidizing means placeable in electric contact with the sheath removed portion of the cable, the reduced radius portion of the trough of the cap member, and the reduced radius portion of the trough of the base member.

5. The invention of claim 4 where the electrically conductive anti-oxidizing means comprises a thin film of a metal particle and graphite containing hydrophobic paste placeable on the sheath removed portion of the cable for substantially filling any spaces between the sheath removed portion of the cable and the reduced radius portion of the troughs of the cap member and base member.

6. The invention of claim 1 wherein each of the troughs of the cap member and the base member include (a) a first generally frustoconical lip extending between the first enlarged radius portion and the reduced diameter portion, and (b) a second generally frustoconical lip extending between the second enlarged radius portion and the reduced diameter portion.

7. The invention of claim 6 wherein the reduced radius portions of the troughs of each of the base member and the cap member have a generally constant cross sectional area throughout their length, the first enlarged radius portion of the troughs of each of the base member and the cap member have a generally constant cross sectional area throughout their length, the second enlarged radius portions of the troughs of each of the base member and the cap member have a generally constant cross sectional area throughout their length, and the cross sectional area of the first enlarged radius portions of each of the base member and cap member is generally equal to the cross sectional area of the second enlarged radius portion of each of the base member and the cap member.

8. The invention of claim 1 wherein the first enlarged diameter portion of the cylindrical bore has a generally constant cross sectional area throughout its length, the second enlarged diameter portion of the cylindrical bore has a generally constant cross sectional area throughout its length, and the reduced diameter portion of the cylindrical bore has a generally constant cross sectional area throughout its length.

9. The invention of claim 1 wherein the grounding block includes a plurality of generally parallel cylindrical bores for receiving a plurality of continuous coaxial cables.

10. The invention of claim 1 wherein the base member includes a first and a second flange portion extending outwardly beyond the base member, each of the first and second flange portions including a positioning aperture extending between the upper surface and the lower surface of the base member, further comprising an electrically conductive mounting fixture having a generally planar surface, and first and second apertures, the first aperture being positioned to alignable with the positioning aperture of the first flange, and the second aperture being positioned to be alignable with the positioning aperture of the second flange, a second fastening means receivable by the positioning apertures of the base member and the first and second apertures of the mounting fixture for mounting the base member to the mounting fixture to form a surface-to-surface electrically conductive relation between the lower surface of the base member and the generally planar surface of the mounting fixture, and a third fastening means for fastening the mounting fixture to a transmission tower.

11. A grounding system for use with a transmission tower comprising, (1) a continuous coaxial cable having a first sheathed portion, a second sheathed portion, and a sheath removed portion extending between the first and second sheathed portions, (2) an electrically conductive grounding block having an upper surface, a generally planar lower surface, a front surface and a rear surface, a cylindrical bore extending between the front surface and the rear surface, the cylindrical bore including (a) a first enlarged diameter portion disposed adjacent to the front surface and sized for snugly receiving the first sheathed portion of the coaxial cable, (b) a second enlarged diameter portion disposed adjacent the rear surface, and sized for snugly receiving the second sheathed portion of the coaxial cable, and (c) a reduced diameter portion for snugly receiving the sheath-removed portion of the coaxial cable, (3) an electrically conductive anti-oxidizing means disposed between the sheath removed portion of the coaxial cable and the cylindrical bore for filling any spaces therebetween, (4) an electrically conductive mounting fixture having a generally planar surface having an area at least as large as the area of the lower surface of the grounding block, and (5) fastening means for fastening the grounding block to the mounting fixture to place the lower surface of the grounding block in an electrically conductive contact with the planar surface of the mounting fixture to form an electrically conductive surface-to-surface contact area between the grounding block and the mounting fixture at least as large as the area of the lower surface of the grounding block.

12. The invention of claim 11 further comprising means for mounting the mounting fixture in an electrically conductive relation to a portion of the transmission tower.

13. The invention of claim 12 wherein the first enlarged diameter portion of the cylindrical bore has a generally constant cross section along its entire length, the second enlarged diameter portion of the cylindrical bore has a generally constant cross section along its entire length, and the reduced diameter portion of the cylindrical bore has a generally constant cross section along its entire length.

14. The invention of claim 13 wherein the electrically conductive anti-oxidizing means comprises a film of a metal particle and graphite containing paste placeable on at least one of the cylindrical bore and sheath removed portion of the coaxial cable for substantially filling any spaces therebetween.

15. The invention of claim 14 wherein the grounding block comprises an extruded metal block, and the cylindrical bore comprises a machined cylindrical bore.

* * * * *